US008020662B1

(12) United States Patent
Colon et al.

(10) Patent No.: US 8,020,662 B1
(45) Date of Patent: Sep. 20, 2011

(54) ACOUSTIC BASE TRAY FOR A DISHWASHING APPLIANCE, AND ASSOCIATED METHOD

(75) Inventors: Mario Ascander Colon, Raleigh, NC (US); Jason Duckworth, Kinston, NC (US); Gregory Van Vooren, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 12/841,883

(22) Filed: Jul. 22, 2010

(51) Int. Cl.

| | |
|---|---|
| ***G10K 11/00*** | (2006.01) |
| ***E04B 1/82*** | (2006.01) |
| ***E04B 2/02*** | (2006.01) |
| ***B08B 3/00*** | (2006.01) |

(52) U.S. Cl. ..... 181/205; 181/286; 181/290; 181/293; 134/57 D; 134/58 D; 134/115 R

(58) Field of Classification Search ..... 181/205, 181/290, 293, 286; 134/18, 57 D, 58 D, 134/115 R See application file for complete search history.

(56) References Cited

U.S. PATENT DOCUMENTS

| | | | | |
|---|---|---|---|---|
| 1,554,179 | A * | 9/1925 | Trader | 181/293 |
| 2,280,631 | A * | 4/1942 | Coffey | 181/293 |
| 2,320,737 | A * | 6/1943 | Hutten | 181/293 |
| 2,556,884 | A * | 6/1951 | Muller | 181/290 |
| 3,529,881 | A * | 9/1970 | Kaldenberg | 312/276 |
| 4,461,796 | A * | 7/1984 | Fukahori et al. | 428/116 |
| 4,746,117 | A | 5/1988 | Noble et al. | |
| 5,013,597 | A * | 5/1991 | Kracke | 428/141 |
| 5,044,705 | A | 9/1991 | Nelson | |
| 5,056,341 | A | 10/1991 | Mori et al. | |
| 5,368,379 | A | 11/1994 | Wrangberth | |
| 5,515,702 | A | 5/1996 | Park | |
| 5,916,681 | A * | 6/1999 | Cipin | 428/403 |
| 6,035,965 | A * | 3/2000 | Fujiwara et al. | 181/293 |
| 6,598,701 | B1 * | 7/2003 | Wood et al. | 181/290 |
| 7,011,181 | B2 * | 3/2006 | Albin, Jr. | 181/290 |
| 7,308,965 | B2 * | 12/2007 | Sapoval et al. | 181/210 |

(Continued)

FOREIGN PATENT DOCUMENTS

DE 23 47 252 A1 3/1975

(Continued)

OTHER PUBLICATIONS

International Search Report and Written Opinion for International Appl. No. PCT/US2010/021128, mailed Aug. 16, 2010.

*Primary Examiner* — Elvin G Enad
*Assistant Examiner* — Christina Russell
(74) *Attorney, Agent, or Firm* — Alston & Bird LLP

(57) ABSTRACT

An apparatus and associated method for attenuating noise generated by a dishwashing appliance in operation is provided herein. During operation a dishwasher and its components generate thermo-acoustic waves associated with noise. A base tray comprising a major surface and an array of thermo-acoustic nodes are used to manage and control the thermo-acoustic waves. The array of thermo-acoustic nodes can be configured in a plurality of rows and columns with at least two thermo-acoustic nodes being interconnected. The array of thermo-acoustic nodes can be configured to channel the thermo-acoustic waves therebetween so as to control and manage the thermo-acoustic waves, thereby attenuating the noise associated with the thermo-acoustic waves. The base tray can be customizable with various arrangements of different thermo-acoustic nodes, clusters, stabilizers and/or channels.

23 Claims, 17 Drawing Sheets

U.S. PATENT DOCUMENTS

| | | | | |
|---|---|---|---|---|
| 7,409,959 | B2 | 8/2008 | Retsema | |
| 2004/0084068 | A1* | 5/2004 | Hur et al. | 134/58 D |
| 2006/0254854 | A1 | 11/2006 | Herrera et al. | |
| 2008/0223421 | A1* | 9/2008 | Rosenbauer et al. | 134/57 D |
| 2008/0236637 | A1 | 10/2008 | Pyo et al. | |
| 2008/0238274 | A1 | 10/2008 | Seo et al. | |
| 2008/0289664 | A1 | 11/2008 | Rockwell et al. | |
| 2009/0102336 | A1 | 4/2009 | Buehlmeyer et al. | |
| 2010/0180916 | A1* | 7/2010 | Colon et al. | 134/18 |
| 2010/0187958 | A1* | 7/2010 | Colon | 312/228 |

FOREIGN PATENT DOCUMENTS

| | | | |
|---|---|---|---|
| DE | 44 43 919 | A1 | 6/1996 |
| DE | 196 03 710 | | 8/1997 |
| DE | 101 18 632 | A1 | 10/2002 |
| DE | 10 2005 061 805 | A1 | 6/2007 |
| WO | WO-2008/141380 | A1 | 11/2008 |

* cited by examiner

ACOUSTIC BASE TRAY FOR A DISHWASHING APPLIANCE, AND ASSOCIATED METHOD

BACKGROUND OF THE DISCLOSURE

1. Field of the Disclosure

Embodiments of the present invention are directed to noise-reduction measures for appliances and, more particularly, to an integrally-formed acoustic base tray for a dishwashing appliance and an associated method.

2. Description of Related Art

A dishwasher typically includes a wash tub for containing the dishware to be washed. However, the tub must also include surrounding structure and components to form the overall dishwasher assembly. The components, such as the various controls, valves, pumps, and the like are mounted outside the tub, but are included within the overall structure of the dishwasher assembly. Accordingly, the tub may be supported by an integrally-molded base, wherein the base is fastened to the tub in order to support the dishwasher assembly. Many of the various components are mounted to the base and under the tub. The base may be molded, for example, from a talc-filled polypropylene, and may include molded recesses and mounting surfaces for particular components such as the control board, valves, pumps, and the like. The base may also be molded to receive a cover member (i.e., a bottom cover or "base tray") over the lower opening that, in instances of the dishwasher requiring service, may be removed from the bottom of the dishwasher to allow access to the various components received by the base.

The "enclosure" aspect afforded by the base tray with respect to the molded base may also contain noise generated by the various operational components of the dishwasher. In doing so, a foam rubber or other insulation layer may be applied externally to the base tray to facilitate the sound absorption/containment within the base. However, the foam rubber layer undesirably adds another component and associated expense to the manufacturing process. In addition, the foam rubber layer may not necessarily be effective in attenuating the frequencies of noise produced by the various components of the dishwasher. Still further, the foam rubber layer may be prone to detachment or damage, thereby reducing the noise reduction capabilities. In still other instances, the base tray/foam rubber layer may undesirably form a "reverberation chamber" with the base and thus may, in some cases, amplify the noise generated by dishwasher components.

In one instance, the dishwasher base tray may be configured as a flat plate, possibly molded of a polymeric material, and have structural ribs for stiffening the structure of the base tray. It was found, however, that such a structure tended to vibrate and resonate during operation of the dishwasher, thereby increasing the overall noise emanating from the unit. Multiple changes in design, material and material densities were performed to stiffen and/or reduce the noise level associated with the base tray. In this regard, one measure involved adding two dampening panels to reduce structure-borne (vibration) sound. Special mounting grommets were introduced to reduce structure-borne sound generated by the motor and transmitted/amplified by the motor bracket and the stiff base tray. However, the effects of these measures were found to be limited to absorbing/reducing sound waves directed toward the base in the range of between about 80 Hz and about 200 Hz. Sound waves reflected, refracted, emitted, and/or transmitted at higher frequencies by other operational components within the dishwasher did not appear to be attenuated. Thus, it was found that the base tray configured in this manner, including structural ribs, actually enhanced the sound/noise created, emitted, and transmitted by this component during operation of the dishwasher unit. Additional undesirable acoustic effects were found to be related to temperature and the stress associated therewith: a cold base tray tended to generate low tone (frequency) resonances, and a hot or heated base tray tended to generate mid tone (frequency) resonances.

Thus, there exists a need for a base tray for enclosing the base of an appliance, such as a dishwasher, wherein the base tray is capable of attenuating, dissipating, or otherwise reducing the sound/noise generated by the base tray itself or other components of the appliance during operation of the appliance, due to vibrations or other wave energy (e.g., heat) imparted thereto by operational components of the appliance. Such a solution should be relatively simple and cheap to implement, be robust and durable, and be readily reconfigurable in the event of changes in appliance components or operational conditions associated therewith.

BRIEF SUMMARY OF THE DISCLOSURE

The above and other needs are met by aspects of the present disclosure, wherein one aspect provides an apparatus and associated method for attenuating noise generated by a dishwashing appliance during operation. In particular, the apparatus could comprise a base tray exposed to vibrations in the dishwashing appliance. The base tray includes an array of thermo-acoustic nodes configured in a manner such that the vibrations from the components are managed and dispersed across the array of thermo-acoustic nodes so as to attenuate the noise created from the vibrations.

One embodiment of the invention is directed to a base tray operably engaged with a dishwashing appliance and configured to manage and control thermo-acoustic waves associated with noise generated by the dishwashing appliance in an operational state, wherein the thermo-acoustic waves comprise vibrations and/or sound waves. The base tray comprises a major surface and an array of thermo-acoustic nodes disposed on the major surface and defined by a plurality of rows and a plurality of columns. At least two of the thermo-acoustic nodes are interconnected and configured to channel the thermo-acoustic waves therebetween so as to control and manage the thermo-acoustic waves, thereby attenuating the noise associated with the thermo-acoustic waves. According to one aspect, the thermo-acoustic nodes can be interconnected between adjacent rows or columns to create clusters. Furthermore, the base tray may also comprise distribution channels defined by the interconnection of adjacent thermo-acoustic nodes.

In other embodiments, a plurality of the thermo-acoustic nodes may comprise different shapes. For example, a plurality of the thermo-acoustic nodes could comprise a hexagonal shape or a diamond shape. The thermo-acoustic nodes could also be different sizes from one another. Additionally, the array of thermo-acoustic nodes could comprise low-frequency nodes for attenuating noise having a frequency between about 50 Hz and about 300 Hz, mid-frequency nodes for attenuating noise having a frequency between about 300 Hz and about 7 kHz, and/or high-frequency nodes for attenuating noise having a frequency between about 7 kHz and about 10 kHz. Moreover, the base tray and the array of thermo-acoustic nodes could be integrally formed from a single piece of material.

Another embodiment of the invention is directed to a method for managing and controlling thermo-acoustic waves associated with noise generated by the dishwashing appliance in an operational state, wherein the thermo-acoustic waves comprise vibrations and/or sound waves. The method comprises providing a base tray comprising a major surface and an array of thermo-acoustic nodes disposed on the major surface and defined by a plurality of rows and a plurality of columns, at least two of the thermo-acoustic nodes being interconnected. The method further comprises channeling the thermo-acoustic waves between thermo-acoustic nodes so as to control and manage the thermo-acoustic waves and to thereby attenuate the noise associated with the thermo-acoustic waves.

Additionally, another embodiment of the invention is directed to a method of manufacturing a base tray operably engaged with a dishwashing appliance and configured to manage and control thermo-acoustic waves associated with noise generated by the dishwashing appliance in an operational state, wherein the thermo-acoustic waves comprise vibrations and/or sound waves associated with noise generated by the dishwashing appliance. The method comprises forming a base tray comprising a major surface and an array of thermo-acoustic nodes disposed on the major surface and defined by a plurality of rows and a plurality of columns. At least two of the thermo-acoustic nodes are interconnected and configured to channel the thermo-acoustic waves therebetween so as to control and manage the thermo-acoustic waves, thereby attenuating the noise associated with the thermo-acoustic waves.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DISCLOSURE

The present disclosure now will be described more fully hereinafter with reference to the accompanying drawings, in which some, but not all aspects of the disclosure are shown. Indeed, this disclosure may be embodied in many different forms and should not be construed as limited to the aspects set forth herein; rather, these aspects are provided so that this disclosure will satisfy applicable legal requirements. Like numbers refer to like elements throughout.

Figure 1:
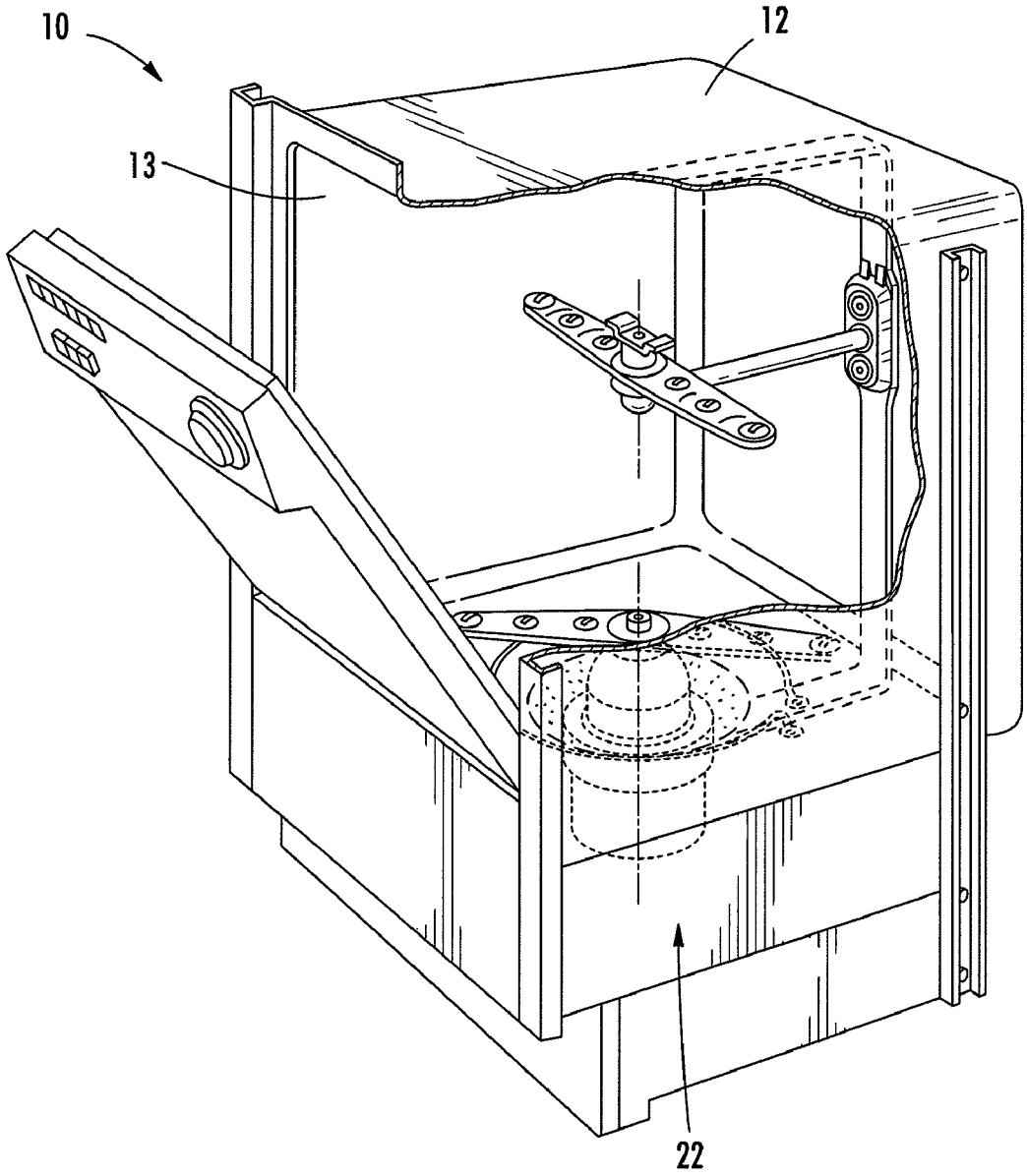
FIG. 1 is a perspective view of a dishwasher, according to one embodiment of the present invention.
Figure 2:
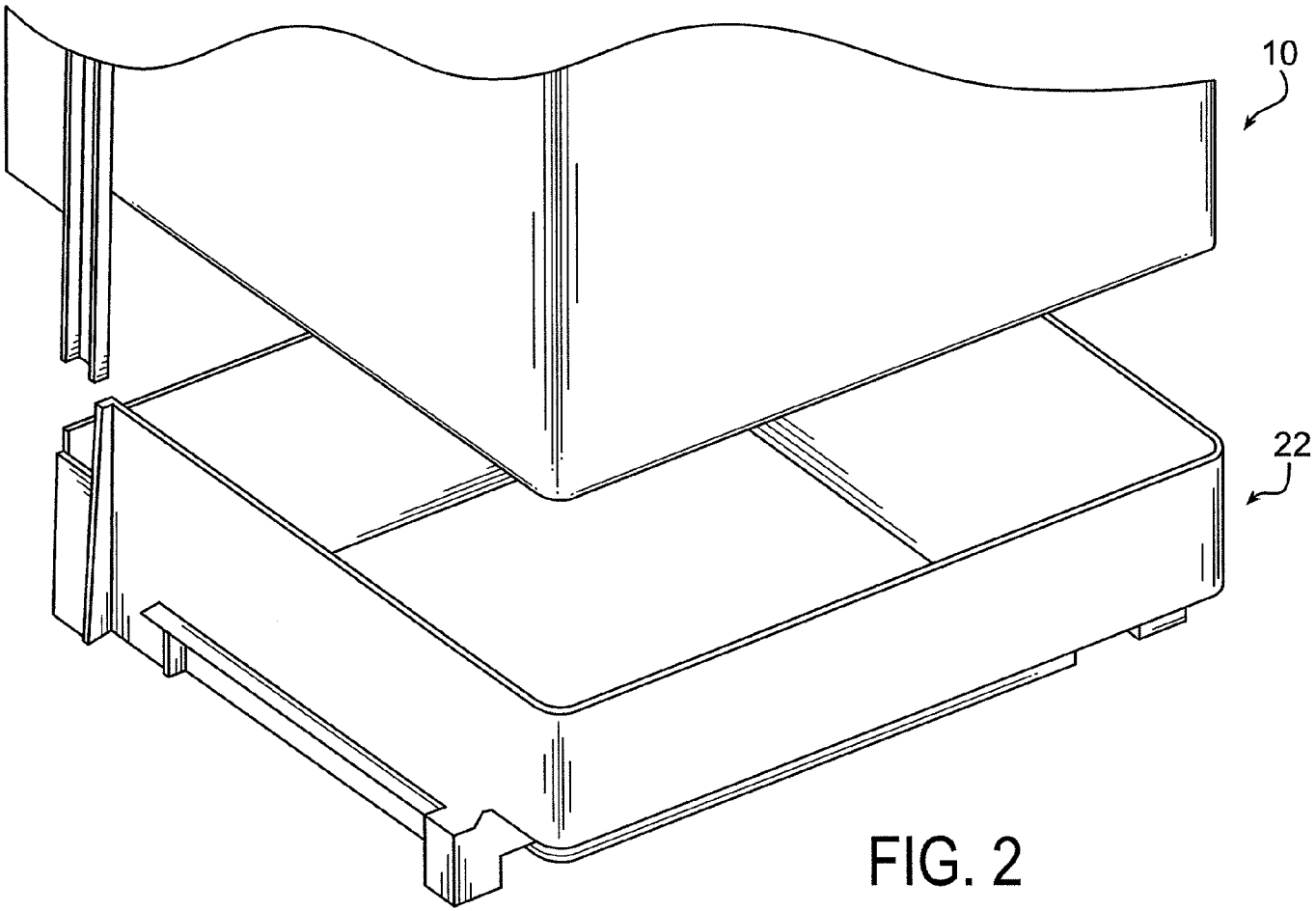
FIG. 2 is a partial exploded view of a dishwasher and a base portion, according to one embodiment of the present invention.

FIG. 1 illustrates one example of a dishwasher 10 capable of washing dishes and utensils. Such a dishwasher 10 typically includes a tub 12 (partly broken away in FIG. 1 to show internal details) having a plurality of walls (e.g., side wall 13) for forming an enclosure in which dishes, utensils, and other dishware may be placed for washing. The dishwasher 10 washes dishware by utilizing various operational components (e.g., spray arms, motors, racks, fill valves, hoses, etc.), and some of these operational components (e.g., motor, circulation pump, drain pump, fill valve, drain valve) may be housed, disposed, or otherwise positioned within a base portion 22 positioned beneath the tub 12 of the dishwasher 10, as shown in FIG. 2. In some instances, the base portion 22 may be a separate component with respect to the tub 12, such as, for example, a molded polymer component, while in other instances the base portion 22 may be integral with the tub 12 such that the side walls forming the tub 12 also at least partially form the base portion 22.

The base portion 22 may be molded to receive a base tray 25 or cover member between the base portion 22 and the tub 12 that, in instances of the dishwasher 10 requiring service, may be removed from the bottom of the dishwasher 10 to allow access to the various components received by the base portion 22. The base tray 25, besides covering some operational components contained in the base portion 22 of the dishwasher 10, can also be utilized to manage and control sound waves emitted during operation of the dishwasher 10. These sound waves can come in the form of vibrations emitted from many different sources during operation of the dishwasher 10, including components of the dishwasher 10 and water flow inside the dishwasher 10.

Sound waves and corresponding vibrations can be affected by temperature, and dishwashers often operate at various temperatures for cleaning purposes. Thus, embodiments of the present invention may take into consideration sound waves affected by the various temperatures inside the dishwasher 10 during operation. Therefore, sound waves and/or vibrations, whether affected by temperature or not, may be referred to as "thermo-acoustic waves" for purposes of discussion herein. Thus, embodiments of the present invention should not be limited to management and control of only sound waves and vibrations, as some embodiments may be configured for management and control of sound waves and vibrations with regard to temperature. Moreover, although the terms "manage" and "control" are used herein, these terms are also not meant to be limiting, as the base tray is configured to channel, relocate, cancel, disperse, attenuate, dissolve, dampen, and/or direct the thermo-acoustic waves to thereby manage and control thermo-acoustic waves in order to attenuate noise generated by the dishwasher.

The thermo-acoustic waves may include different types of sound waves and in one embodiment, form a sound envelope inside the dishwasher 10. This sound envelope comprises non-linear thermal sound waves generated by various components of the dishwasher, such as non-linear water, emission, and transmission thermal sound waves. The non-linear water thermal sound waves are generated from water flow inside components of the dishwasher (e.g., recirculation hoses, motors, drain pumps, fill valves, etc.). The non-linear emission thermal sound waves are generated by various components in the dishwasher, such as motor shields, drain pumps, and fans. The non-linear transmission thermal sound waves are generated by components such as spray arms, dishes, racks, and dry valves. The non-linear sound wave transmission, emission, distribution rates across the base tray 25 depend on various factors, such as angles of incidence, reflection, refraction, absorption, amplification, a mix of which are linear with time. As explained in further detail below, the base tray 25 is configured to manage and control the sound envelope so as to reduce the noise generated by the dishwasher.

One embodiment of a base tray 25 (shown in FIG. 3), is configured to be placed inside the base portion 22 for attenuating, dissipating, or otherwise reducing the sound/noise generated due to thermo-acoustic waves imparted thereto by the operational components of the dishwasher 10. The base tray 25 is customizable for different types of dishwashers, as many different components are used in different dishwashers, such different components generating different thermo-acoustic waves. The base tray 25 is also configured to interact with specific components of the dishwasher. The particular configuration of the base tray 25 can be determined by measuring the sound waves and vibrations generated by the dishwasher and calculating a specific configuration of the base tray 25 that will manage and control the thermo-acoustic waves. Additionally, the base tray 25 may also be used in other appliances for managing and controlling thermo-acoustic waves created during operation and, thus, is not limited for use in dishwashers.

The base tray 25 is configured to reduce sound by managing and controlling the thermo-acoustic waves created by components and operating noises of the dishwasher 10. Thus, the particular configuration of the base tray 25, instead of stiffness, can be beneficial in managing or controlling thermo-acoustic waves based on controlled vibration of the base tray 25. In one embodiment, the base tray 25 can reduce sound created in frequencies ranging from about 50 Hz to about 10,000 Hz, which corresponds to the wide range of frequencies that are created by the different operating components of the dishwasher 10. The base tray 25 may also relocate resonances in the first, third, and fifth octaves. For discussion purposes, this range of frequencies will herein be described as a combination of low, mid, and high frequencies.

Generally speaking, the base tray 25 reduces the sound of the dishwasher 10 during operation by dispersing the thermo-acoustic waves associated with the components and water flow inside the dishwasher 10. More specifically, in various embodiments, the base tray 25 can be configured to reduce sound by managing thermo-acoustic waves in various ways as described below.

Figure 3:
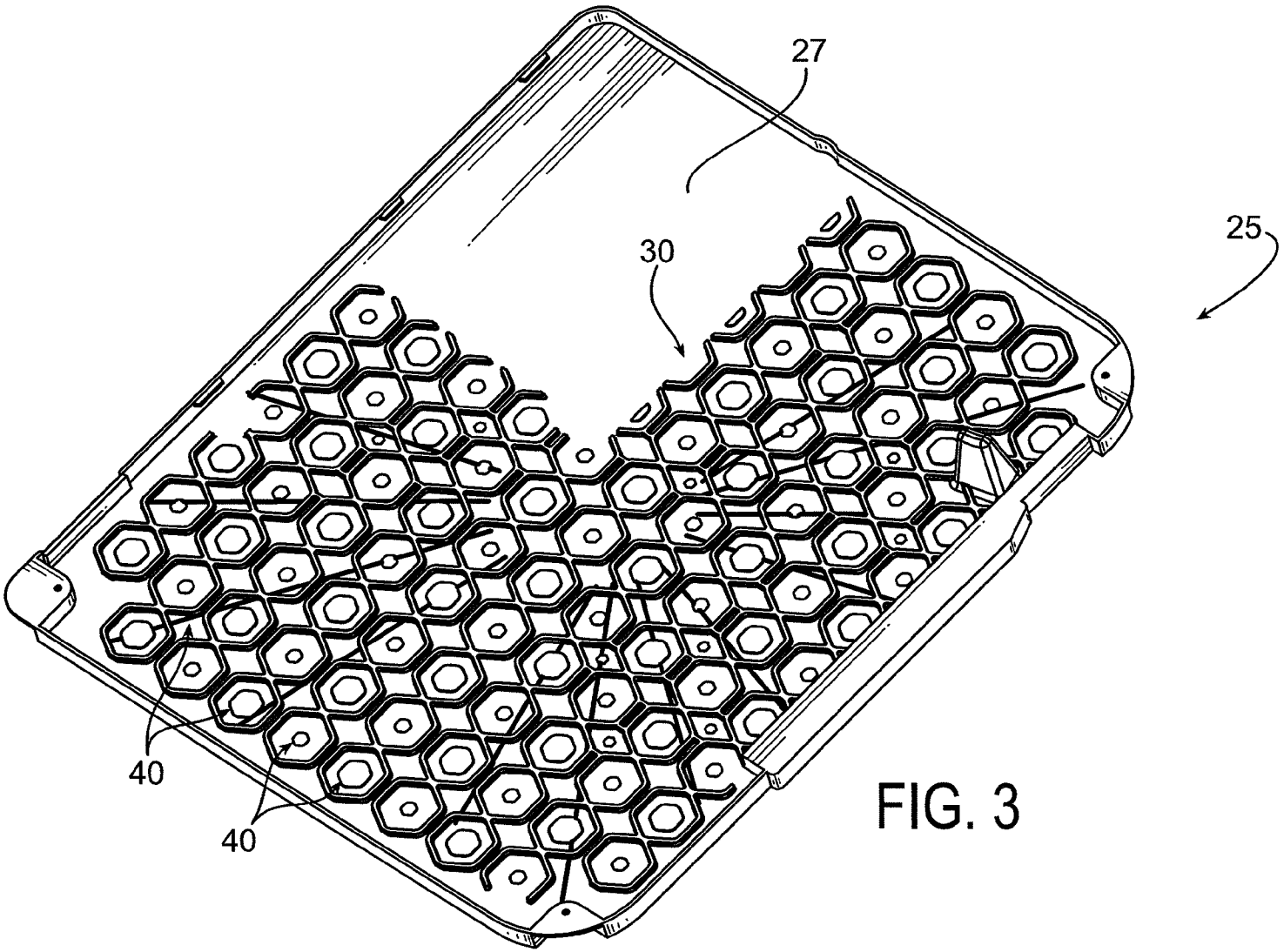
FIG. 3 is a perspective view of one embodiment of a base tray, wherein the base tray includes an array of thermo-acoustic nodes, according to one embodiment of the present invention.
Figure 4:
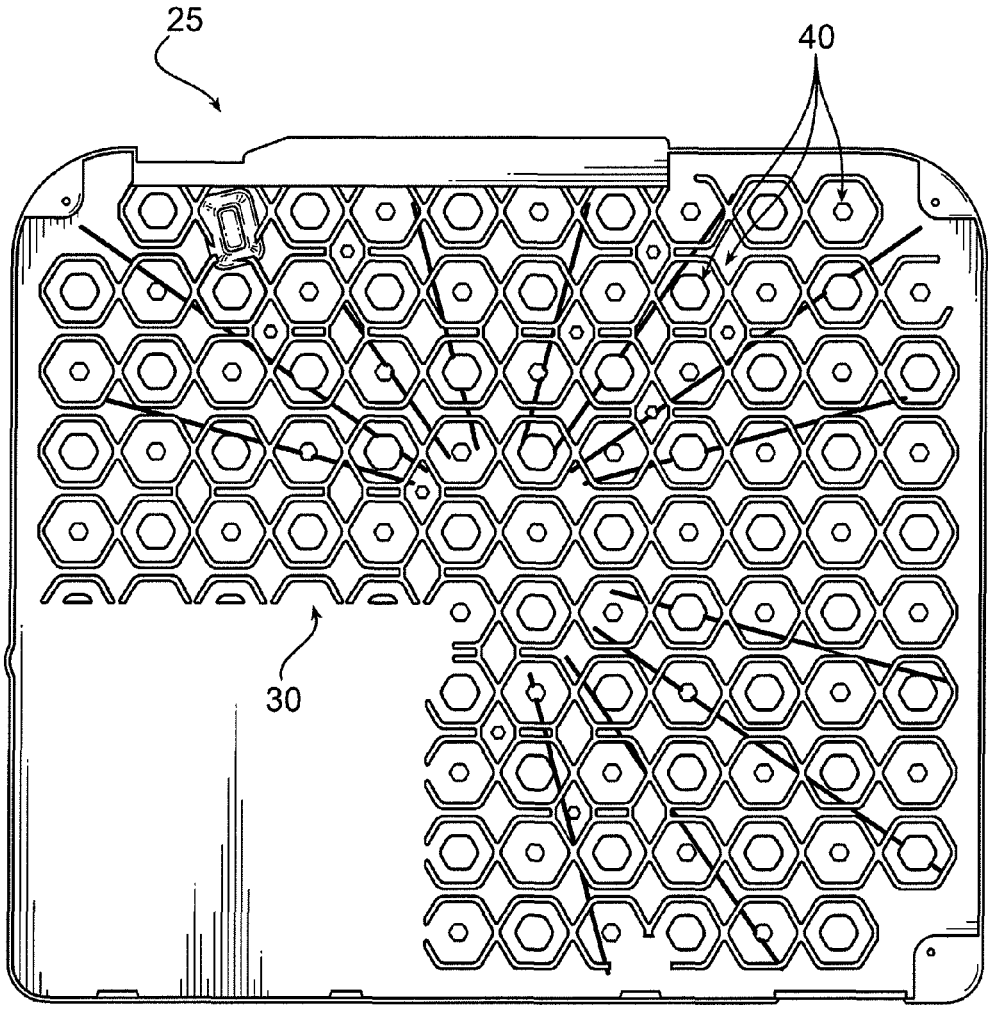
FIG. 4 is a top view of the base tray shown in FIG. 3, according to one embodiment of the present invention.
Figure 5:
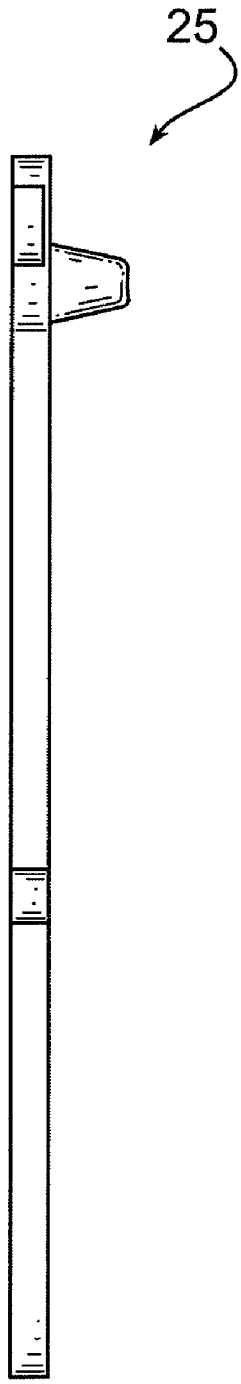
FIG. 5 is a side view of the base tray shown in FIG. 3, according to one embodiment of the present invention.

With reference to FIGS. 3-5, one embodiment of the base tray 25 is shown. The base tray 25 may be a planar member configured to fit inside the base portion 22 of a dishwasher 10. In the depicted embodiment, the base tray 25 comprises an array 30 of thermo-acoustic nodes 40 configured to reduce the sound generated by the dishwasher 10 during operation. The array 30 may include a plurality of rows and a plurality of columns of thermo-acoustic nodes 40. Additionally, the base tray 25 and the array 30 of thermo-acoustic nodes 40 may be integrally formed from a single piece of material. For example, the base tray 25 and the array 30 can formed by injection molding or other polymeric processing techniques.

The array 30 is configured to manage the thermo-acoustic waves created during operation of the dishwasher 10. In particular, the array 30 of thermo-acoustic nodes 40 can be configured to disperse the thermo-acoustic waves to create equivalent frequency modulations that propagate in opposite and parallel directions across the base tray 25, thus dispersing the thermo-acoustic waves, and ultimately reducing the noise. In other words, the thermo-acoustic nodes 40 can be configured across the array 30 to channel thermo-acoustic waves between thermo-acoustic nodes so as to attenuate the noise associated with the thermo-acoustic waves.

The specific arrangement of the thermo-acoustic nodes 40 in the array 30 can be customizable so that each base tray 25 can reduce sound created by different dishwashers with different components and, therefore, different thermo-acoustic wave patterns. As such, various embodiments of the base tray 25 comprise a customizable array 30 which may be configured with different arrangements of thermo-acoustic nodes, clusters, stabilizers, and/or channels for varying frequencies which can be arranged according to each individual dishwasher's thermo-acoustic wave pattern. These different aspects of the array 30 of a base tray 25 are described below.

Figure 6:
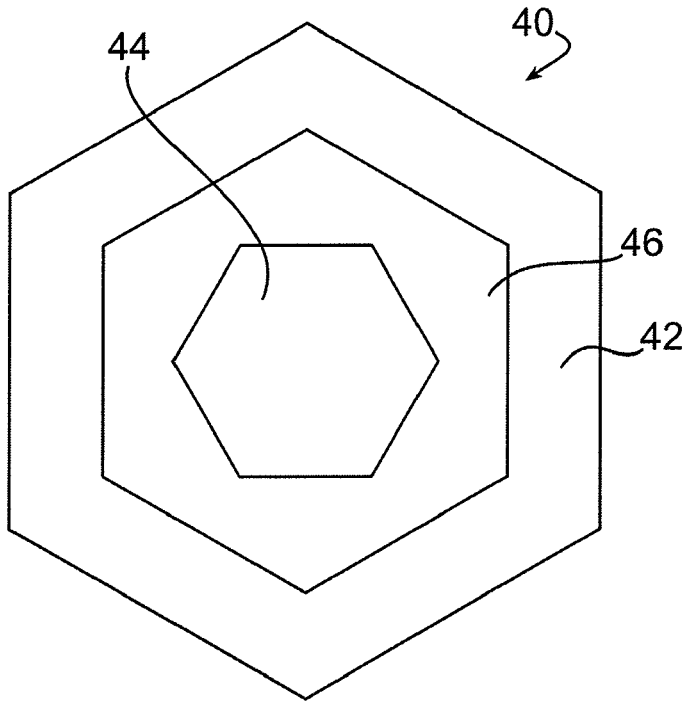
FIG. 6 is an enlarged top view of a thermo-acoustic node, according to one embodiment of the present invention.
Figure 6A:
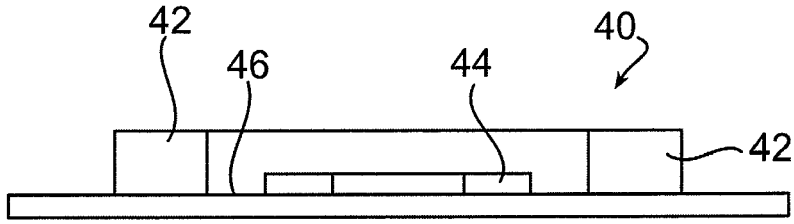
FIG. 6A is a cross-sectional view of the thermo-acoustic node shown in FIG. 6, according to one embodiment of the present invention.

Thermo-acoustic nodes 40 can be configured differently depending upon what frequency they are designed to interact with. With reference to FIGS. 6 and 6A, thermo-acoustic nodes 40 comprise at least one outer wall member 42 that protrudes outwardly from a major surface of the base tray 25. The outer wall member 42 defines the general shape of the thermo-acoustic node 40, which can be any shape, such as a hexagon as shown in FIGS. 3, 4, and 6. Furthermore, the outer wall member 42 may generally bound a thermo-acoustic node 40, but does not have to fully enclose the thermo-acoustic node 40. In some embodiments of the present invention, certain shapes, defined by the outer wall member 42, correspond to different frequency nodes. For example, in the depicted embodiment of FIG. 7, a generally hexagonal shape corresponds to a low or mid-frequency node 50, 60, whereas a generally diamond shape corresponds to a high-frequency node 70, 80, as described in further detail below.

Figure 8:
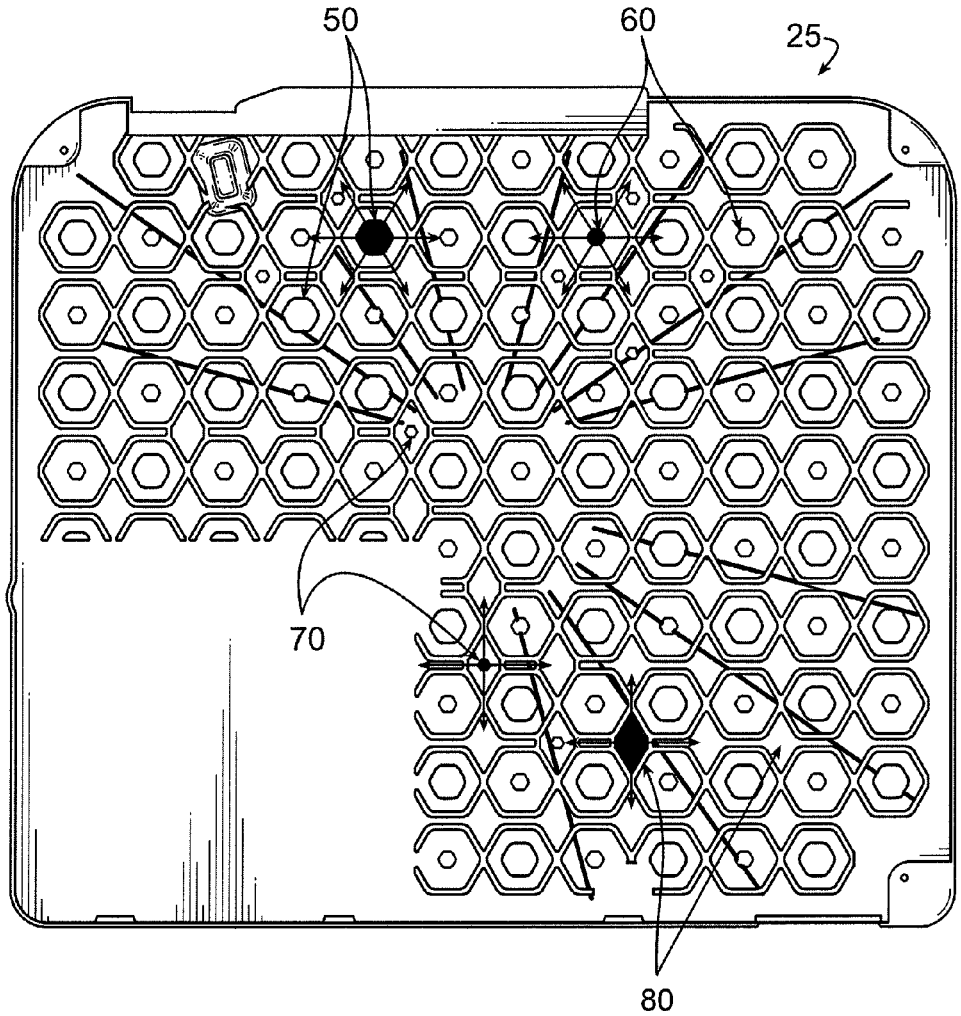
FIGS. 8-16 show a top view of the base tray shown in FIG. 3 with various highlighted features discussed below, according to various embodiments of the present invention.

In other embodiments, thermo-acoustic nodes 40 may also comprise a node member 44. This node member 44 also protrudes outwardly from a major surface of the base tray 25. Additionally, the shape and size of the node member 44 is variable depending on the desired frequency of the node 40, for example, the node member 44 can be hexagonal in shape although other shapes may be employed (e.g., polygonal or circular). Moreover, the height of the protrusion of the node member 44 can be less than the height of the outer wall member 42, as shown in FIG. 6A. The node member 44 is designed to interact with and disperse the thermo-acoustic waves. In particular, as shown in FIG. 8, the thermo-acoustic waves (shown as arrows) interact with each node member 44 of the thermo-acoustic nodes 40 and disperse in different directions. Generally speaking, in the depicted embodiment, the larger the node member 44, the lower the frequency of thermo-acoustic waves it attracts and disperses. Thus, a low-frequency node member 54 is configured to interact with lower frequencies than a mid or high-frequency node member 64, 74

Additionally, as illustrated in FIGS. 6 and 6A, the thermo-acoustic node 40 may comprise a concave portion 46 defined between the node member 44 and the outer wall member 42. The concave portion 46 is defined in a generally concave shape with respect to the node member 44 and the surrounding outer wall member 42 and can also attract different frequency thermo-acoustic waves. Generally speaking, in the depicted embodiment, the larger the concave portion 46, the lower the frequency of thermo-acoustic waves it attracts and disperses. For example, as shown in FIG. 7A, a mid-frequency concave portion 66 is configured to interact with lower frequencies than the low-frequency concave portion 56.

Figure 7:
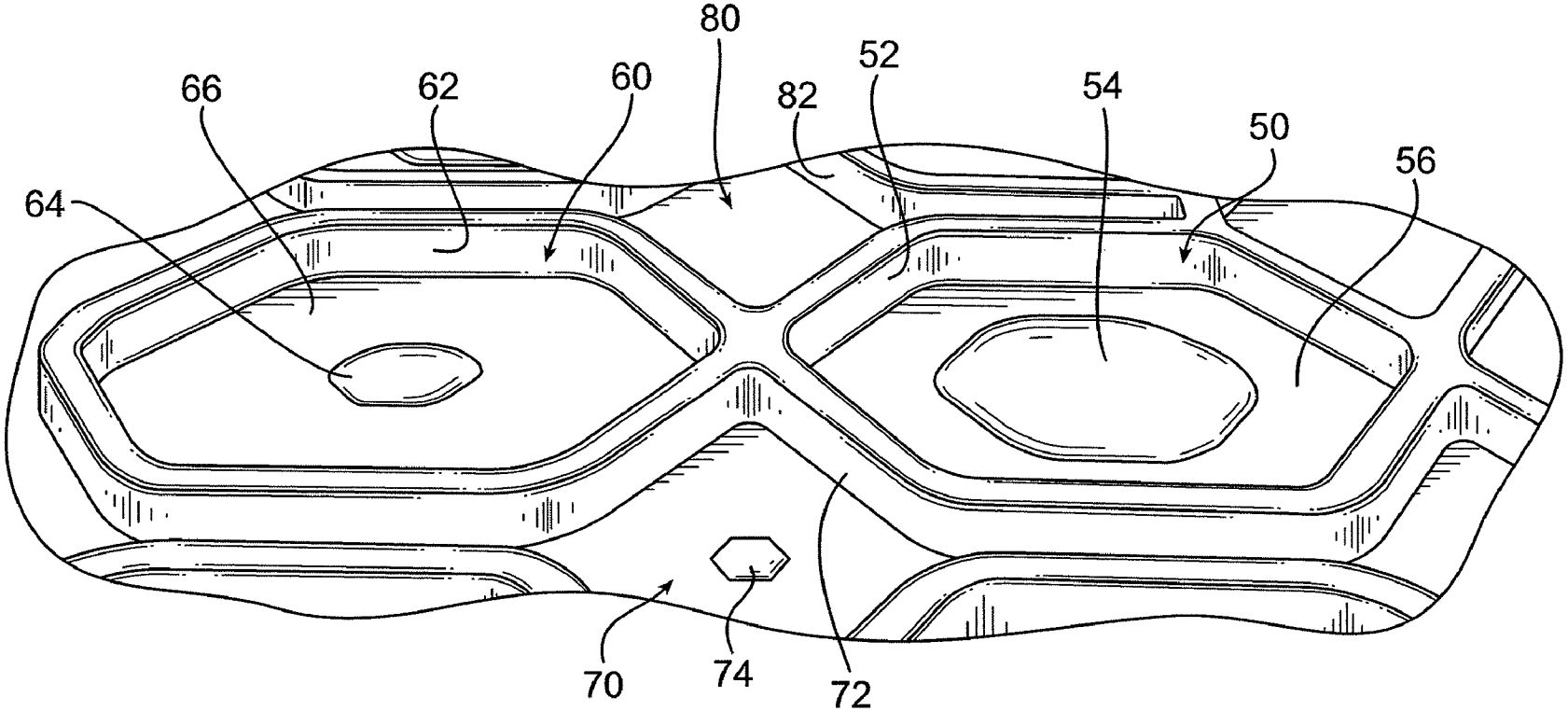
FIG. 7 is an enlarged perspective view of a portion of an array of thermo-acoustic nodes, according to one embodiment of the present invention.
Figure 7A:
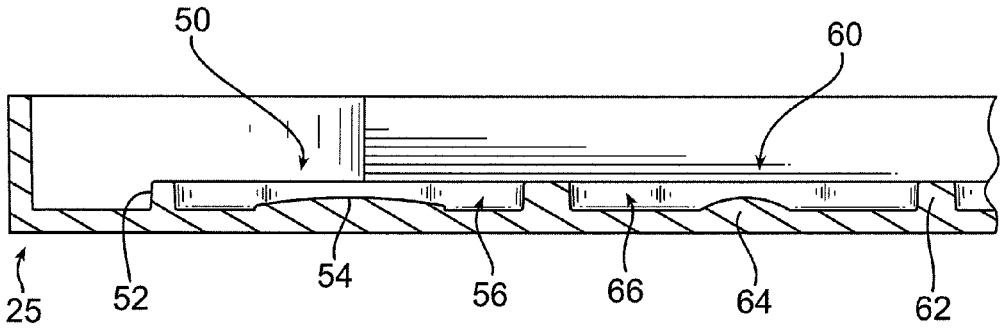
FIG. 7A is a cross-sectional view of a portion of a base tray with an array of thermo-acoustic nodes, according to one embodiment of the present invention.

FIGS. 7, 7A, and 8 illustrate different types of thermo-acoustic nodes 40 that correspond to different frequencies.

Thus, in various embodiments, the array 30 of the base tray 25 may be comprised of any type or combination of types of thermo-acoustic nodes 40. Such thermo-acoustic nodes 40 may be low-frequency nodes 50, mid-frequency nodes 60, or high-frequency nodes 70, 80.

With reference to FIGS. 7 and 7A, both the low-frequency node 50 and mid-frequency node 60 comprise at least one outer wall member 52, 62 surrounding a node member 54, 64. Both the low-frequency outer wall member 52 and the mid-frequency outer wall member 62 form a shape to define the boundaries of the low and mid-frequency nodes 50, 60 respectively. In the depicted embodiment, the shape created by the outer wall members 52, 62 of both nodes 50, 60 are generally hexagonal, but the shape of the nodes is not limited to only a hexagonal shape. In addition, FIG. 7A demonstrates that each node member 54, 64 may have a convex cross-sectional shape. Furthermore, high frequency node members 74 may also have a convex cross-sectional shape.

The low and mid-frequency nodes 50, 60 may include node members 54, 64 that are different sizes and/or shapes. In particular, the low-frequency node member 54 may be larger than the mid-frequency node member 64, as shown in FIGS. 7 and 7 A. Thus, the shape and size of a node member 44 may vary depending on the range of frequencies that it is configured to interact with. For example, the low-frequency node member 54 of the low-frequency node 50 is configured to attract low-frequency thermo-acoustic waves (e.g., about 50 Hz-about 300 Hz), whereas the mid-frequency node member 64 of the mid-frequency node 60 is configured to attract mid-frequencies (e.g., about 300 Hz-about 7 kHz).

Similarly, the size and/or shape of the concave portion 56, 66 may be configured to interact with different frequencies. In particular, the low-frequency concave portion 56 of low-frequency node 50 is configured to attract mid-frequency thermo-acoustic waves, whereas the mid-frequency concave portion 66 of the mid-frequency node 60 is configured to attract low-frequency thermo-acoustic waves. When the outer wall members 52, 62 of both the low and mid-frequency nodes 50, 60 have a similar size and shape, such as is shown in FIG. 7, the mid-frequency node member 64 is smaller than the low-frequency node member 54, which corresponds to the mid-frequency concave portion 66 being larger than the low-frequency concave portion 56. This larger mid-frequency concave portion 66 equates to a generally larger concave shape, which attracts low-frequency thermo-acoustic waves. The opposite is true for the low-frequency node 50, where the low-frequency concave portion 56 is smaller, thereby corresponding to a generally smaller concave shape which attracts mid-frequency thermo-acoustic waves. Therefore, low-frequency nodes 50 and mid-frequency nodes 60 can attract and disperse both low and mid frequencies of thermo-acoustic waves.

As illustrated in FIGS. 7 and 8, there can be different types of high-frequency nodes 70, 80 disposed on the base tray. The first high-frequency node 70 comprises a first node member 74 and at least one first outer wall member 72 defined by the wall members 52, 62 of adjacent nodes 50, 60. The first node member 74 is smaller than the node members 54, 64 of the low and mid-frequency nodes 50, 60. Thus, the first node member 74 can attract and disperse high-frequency thermo-acoustic waves (e.g., about 7 kHz-about 8 kHz). The first outer wall member 72 may form a general boundary around or fully enclose the first high-frequency node 70. In the depicted embodiment, the first outer wall member 72 forms generally a diamond shape, however, any shape can be used, and the first outer wall member 72 does not need to fully enclose the first high-frequency node 70.

The second high-frequency node 80 comprises at least one second outer wall member 82 defined by the wall members of adjacent nodes. In the depicted embodiment, the second outer wall member 82 forms a generally diamond shape, similar to the first high-frequency node 70. However, unlike the first high-frequency node 70, the second high-frequency node 80 does not comprise a node member 44 but, rather, is concave with respect to the surrounding outer wall members 82. The second high-frequency node 80 is configured to attract and disperse even higher frequencies of thermo-acoustic waves (e.g., about 8 kHz-about 10 kHz).

Figure 9:
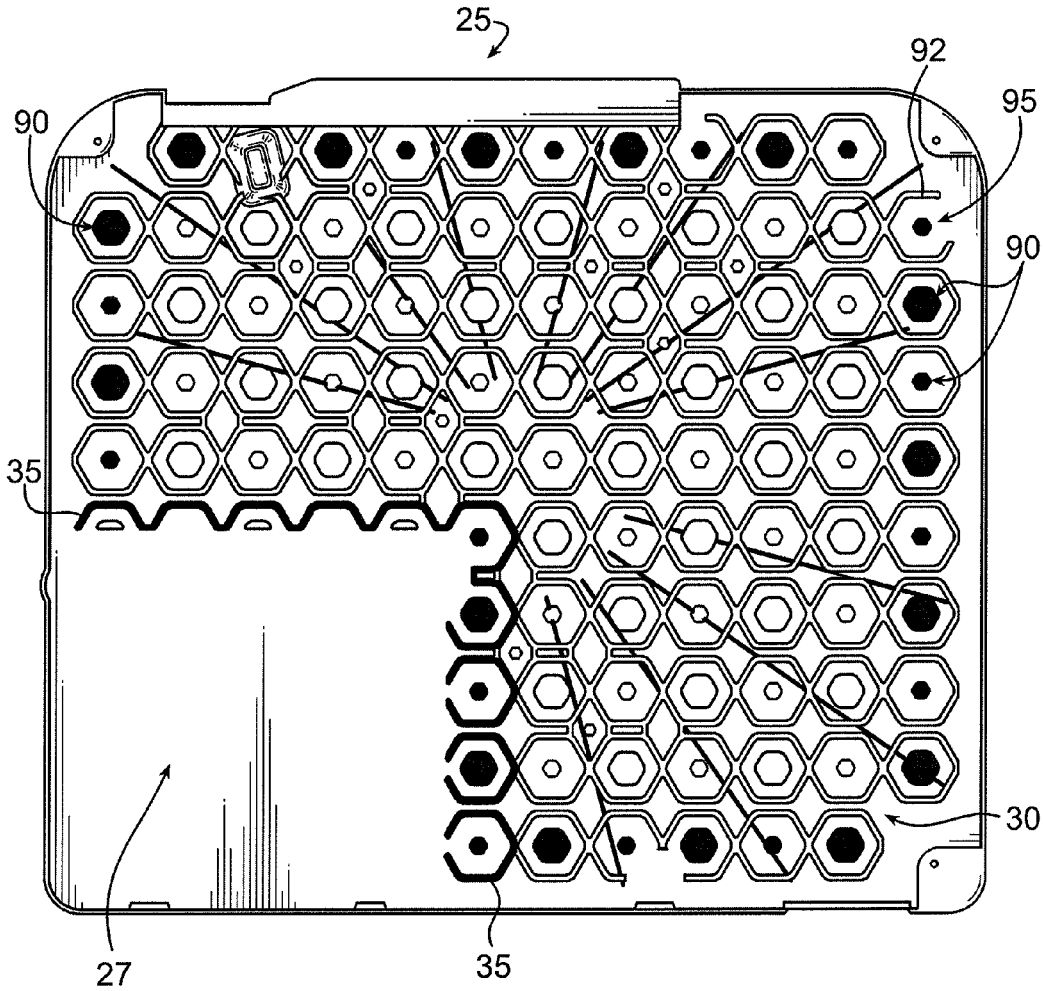

According to one aspect, as shown in FIG. 9, some thermo-acoustic nodes 40 or portions of nodes are configured as displacement nodes 90. The displacement nodes 90 are located around the periphery of the array 30 and are designed to initially disperse the thermo-acoustic waves throughout the array 30 and to cancel out sound resulting from bi-directional transmission of the thermo-acoustic waves. The displacement nodes 90 may be any type of thermo-acoustic node 40, such as a low, mid, first high, or second high-frequency node 50, 60, 70, 80. In the depicted embodiment, the base tray 25 comprises an array 30 with displacement nodes 90 comprised of low and mid-frequency nodes 50, 60. Some displacement nodes 90 may comprise displacement outer wall members 92 that do not fully enclose the displacement node 90, thereby creating a displacement opening 95. In some embodiments the displacement opening 95 may face away from the interior of the array 30 in order to disperse thermo-acoustic waves entering the base tray 25.

In another embodiment, the array 30 may also comprise a sound dam 35. The sound dam 35 comprises at least one displacement node 90 or portion of a node that acts as a sound shield to channel or disperse the sound into the array 30. For example, in FIG. 9 there is a support region 27 in the base tray 25 free of any thermo-acoustic nodes that may support a component of the dishwasher 10, such as a motor or transmitter. Thus, the sound dam 35 may be located adjacent to, and about the periphery of, the support region 27 so that any thermo-acoustic waves emanating from the support region 27 (e.g., sounds created by a motor) would be properly dispersed within the array 30 on the base tray 25.

Figure 10:
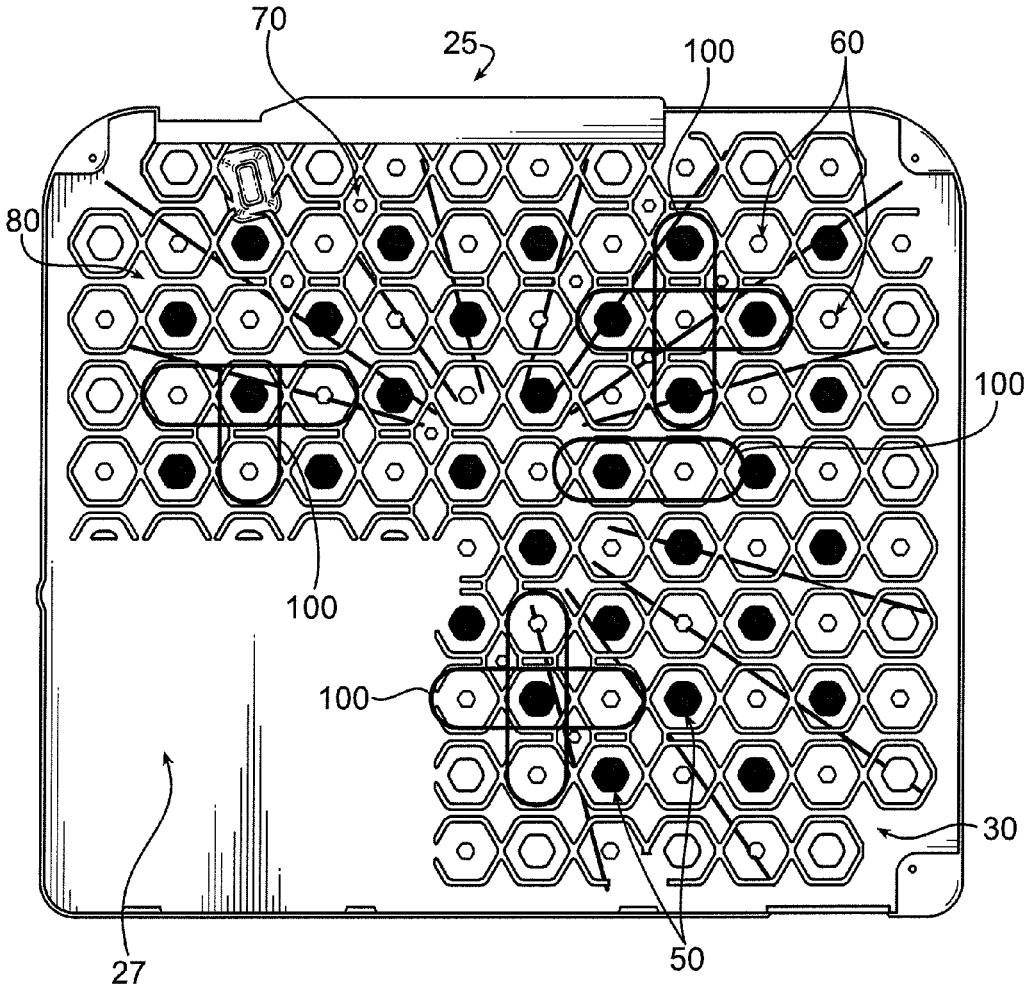
Figure 11:
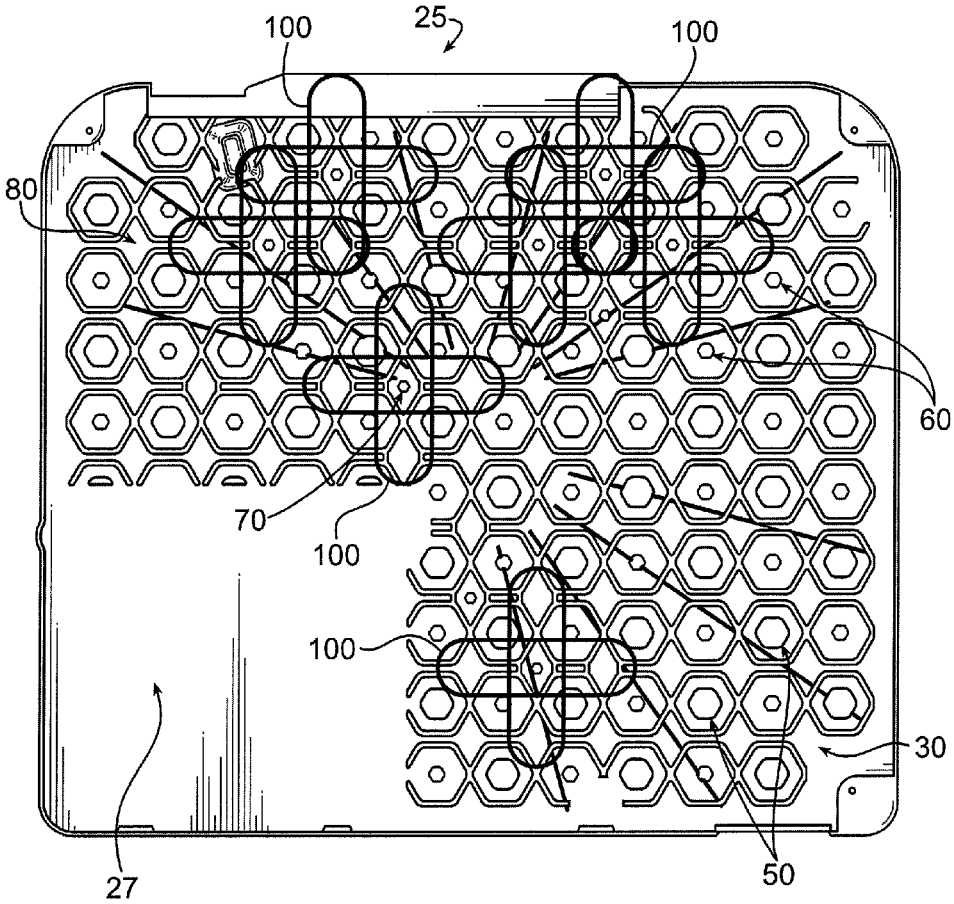

With reference to FIGS. 10-11, in another embodiment, the array 30 of thermo-acoustic nodes 40 may also comprise clusters 100 of thermo-acoustic nodes 40 (circled regions). Clusters 100 comprise adjacent thermo-acoustic nodes 40 or the interconnection of at least two thermo-acoustic nodes 40, such as by sharing a common outer wall member 42 (i.e., common sides) or having otherwise interconnected wall members. The clusters of the thermo-acoustic nodes 40 encourage sound waves to bounce back and forth between the thermo-acoustic nodes 40 inside the cluster 100 in an effort to control them and eventually cancel out the sound being emitted. In the depicted embodiment, the thermo-acoustic nodes 40 generally form a plurality of rows and a plurality of columns across the array 30. As such, a cluster 100 can occur at any interconnection between at least two thermo-acoustic nodes 40 across either a row or a column. Furthermore, clusters 100 can occur between any combination of thermo-acoustic nodes 40 in the array. For example, in the depicted embodiments, some but not all clusters 100 are shown in FIG. 10 between low and mid-frequency nodes 50, 60 (e.g., a cluster of one node 50 and two nodes 60 on opposite sides thereof). Clusters 100 are also shown between first and second high-frequency nodes 70, 80 in FIG. 11 (e.g., a cluster of one node 70 and two nodes 80 on opposite sides thereof).

Figure 12:
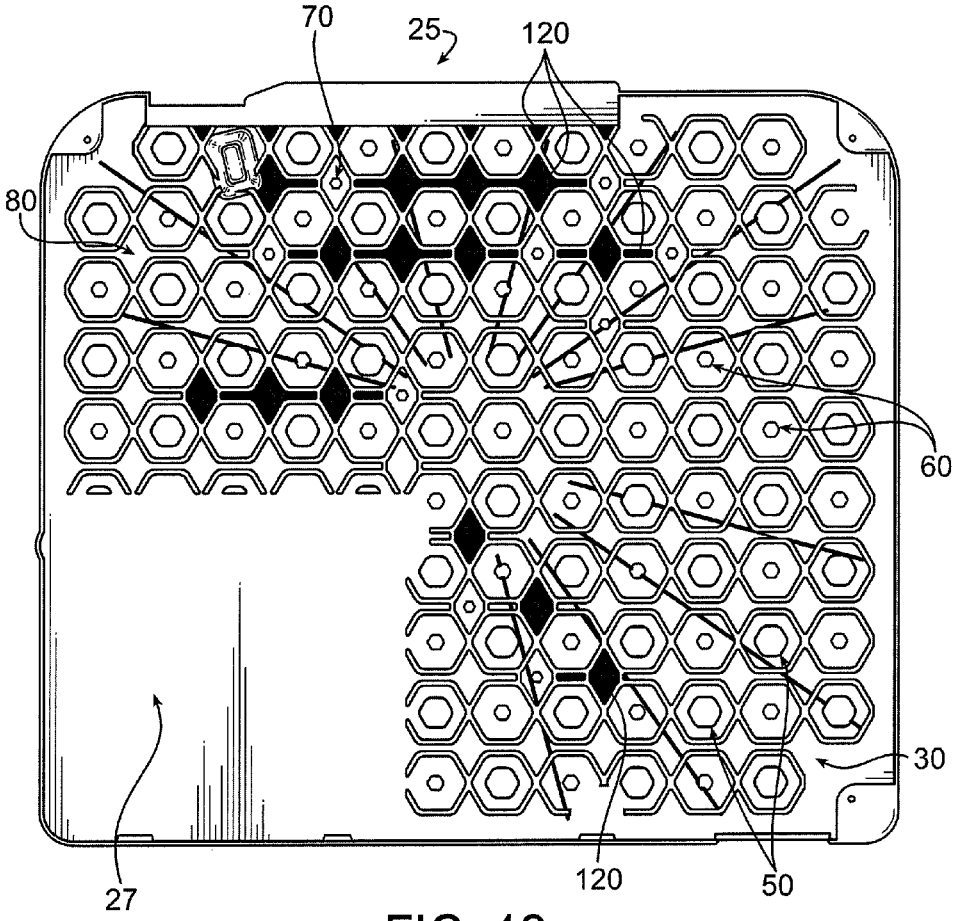

In another embodiment, as illustrated in FIG. 12, the array 30 may also comprise stabilizers 120 (shaded regions). Stabilizers 120 are thermo-acoustic nodes 40 inside the array 30 that are fully enclosed by outer wall members 42, but do not include node members 44. However, multiple interconnected thermo-acoustic nodes 40 may comprise stabilizers 120 if they are ultimately fully enclosed by outer wall members 42 at some point within the array 30. For example, a second high-frequency node 80 (as shown in FIG. 8) does not have a node member 44, but only acts as a stabilizer 120 if either its second wall member 82 fully encloses the boundary of the second high-frequency node 80 or it is eventually fully enclosed by other outer wall members 42. Additionally, stabilizers 120 may comprise other shapes, e.g., rectangles, as shown by the shaded nodes in FIG. 12. Also, stabilizers 120 may be displacement nodes 90 as well, as long as they are fully enclosed and do not contain node members 44. The stabilizers 120 act to rebalance thermo-acoustic waves which have been directed and dispersed across the array 30. In particular, stabilizers 120 may be configured to interact with thermo-acoustic waves generated by specific components. For example, the three diamond shaped stabilizers 120 to the right of the support region 27 are configured to interact with thermo-acoustic waves associated with a hose moving water from the sump into the drain pump, the three interconnected stabilizers above the support region are configured to interact with thermo-acoustic waves associated with the hose moving water from the motor to the filter, while the remaining stabilizers at the top of the tray are configured to interact with thermo-acoustic waves generated by the fuel valve.

Figure 13:
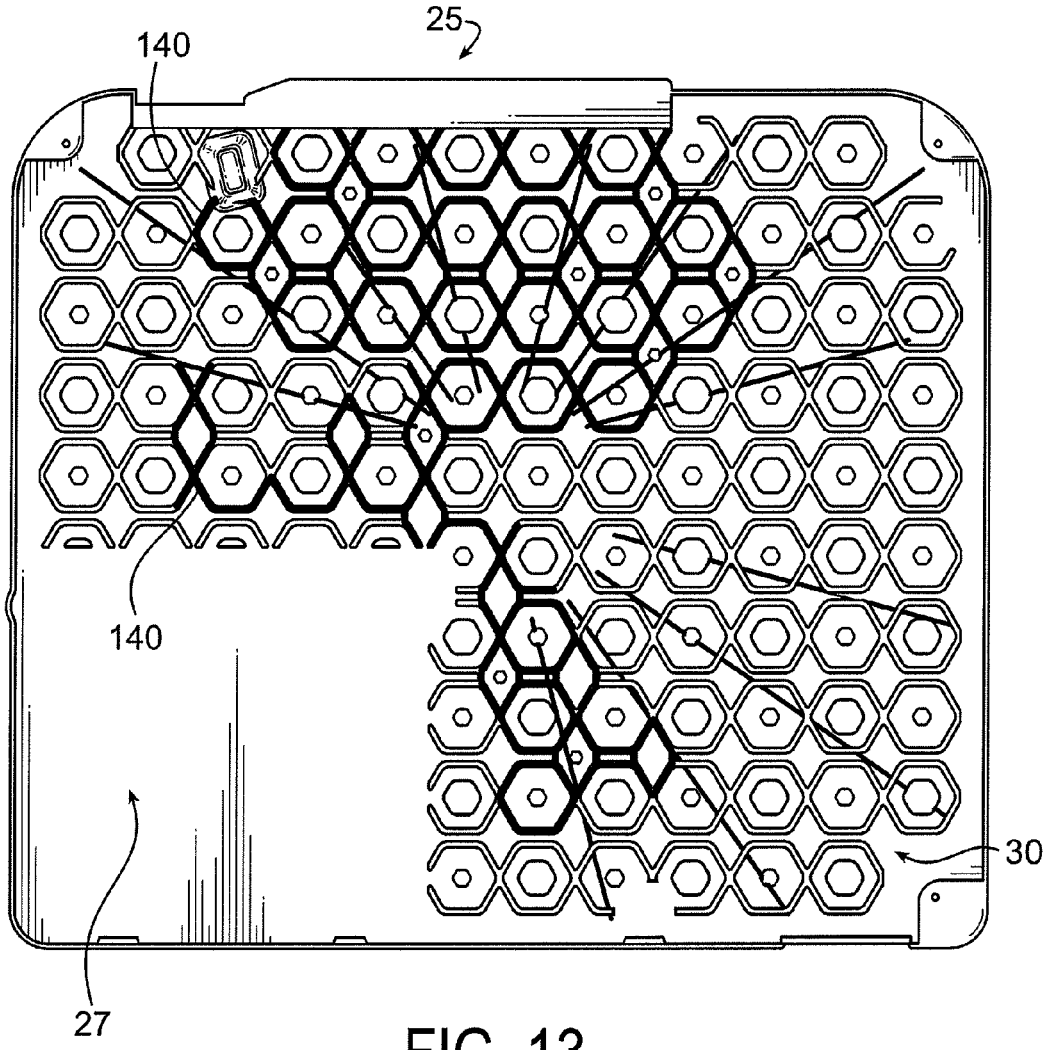
Figure 14:
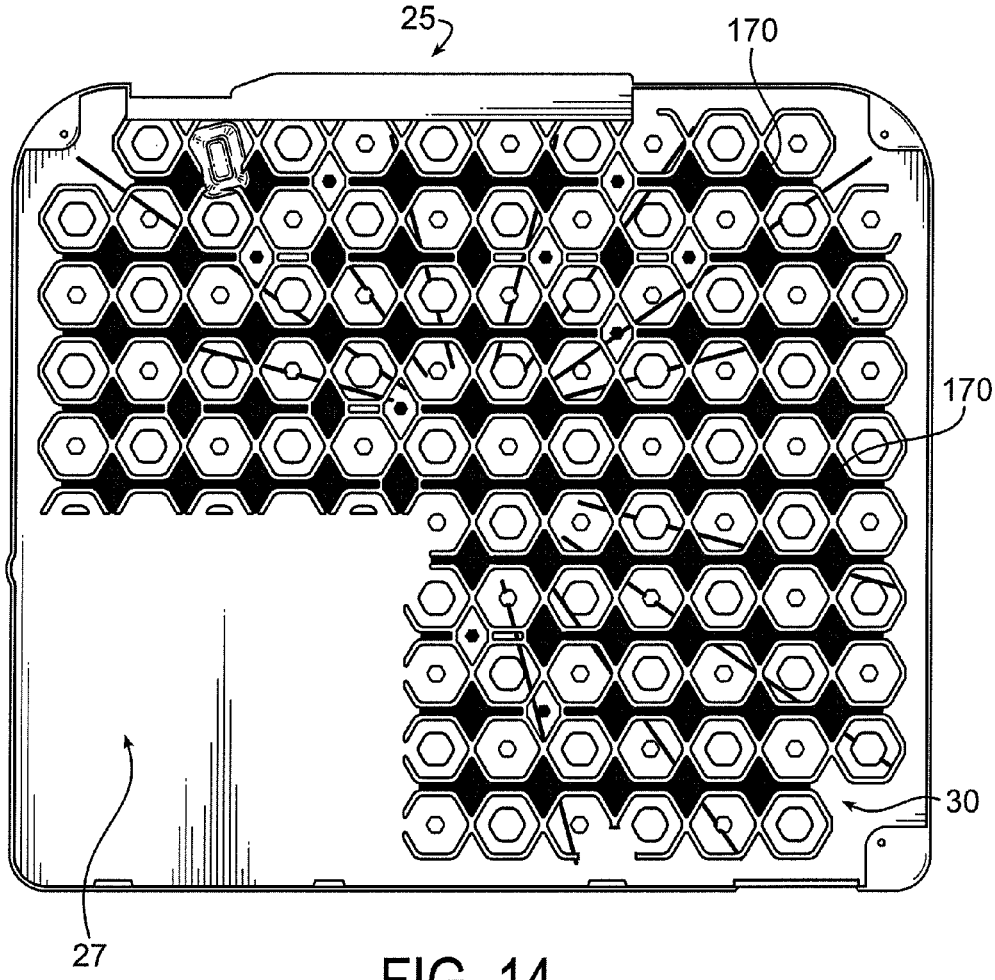

FIG. 13 shows another embodiment of the invention, wherein the base tray 25 may also comprise distribution channels 140 (bolded regions). Distribution channels 140 comprise outer wall members 42 of adjacent thermo-acoustic nodes 40 that are interconnected. Thus, the path of a distribution channel 140 can extend along any interconnected outer wall members 42. Distribution channels 140 encourage thermo-acoustic waves to travel in a certain path across the array 30. Additionally, as shown in FIG. 14, the array 30 can be configured so that the first and second high-frequency nodes 70, 80 form high-frequency channels 170 (shaded regions) that encourage high-frequency thermo-acoustic waves to travel through the array 30 in a desired direction.

Figure 15:
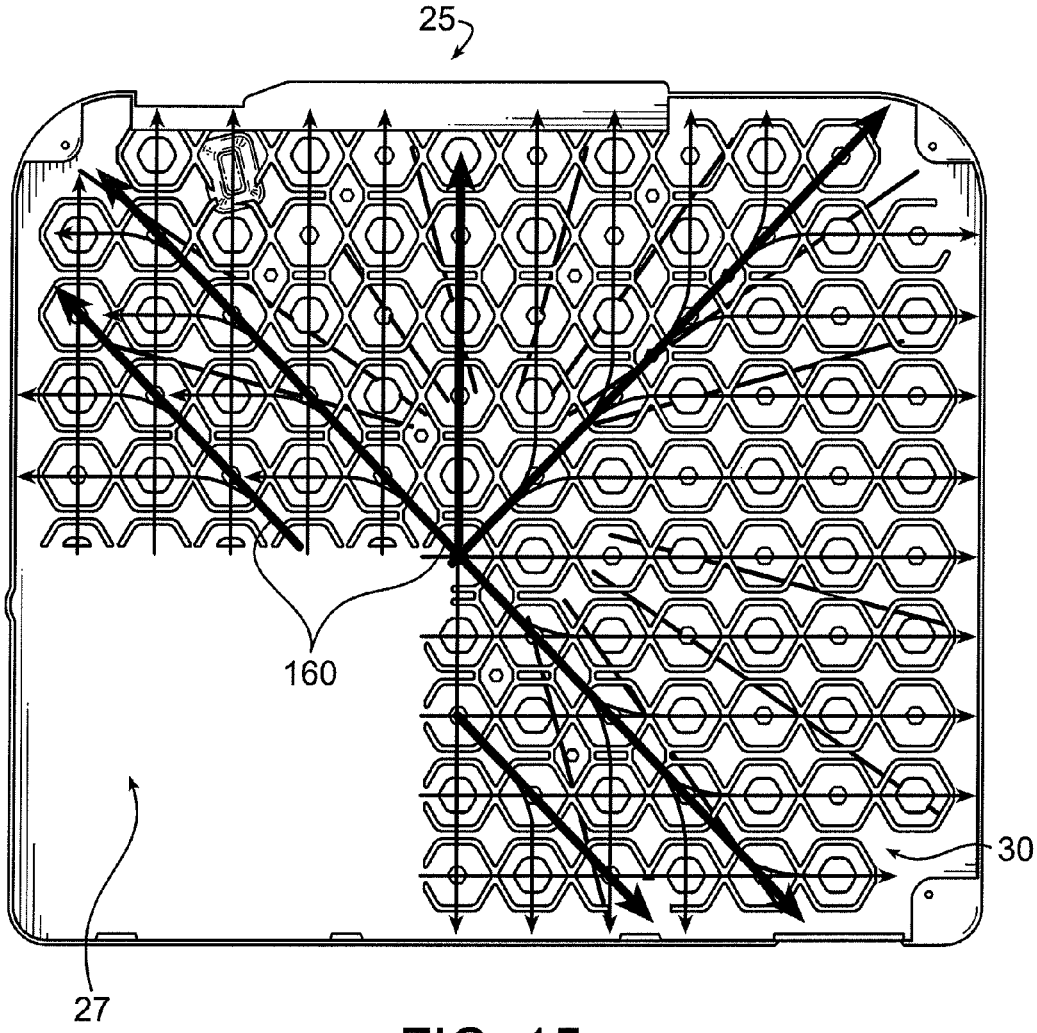
Figure 16:
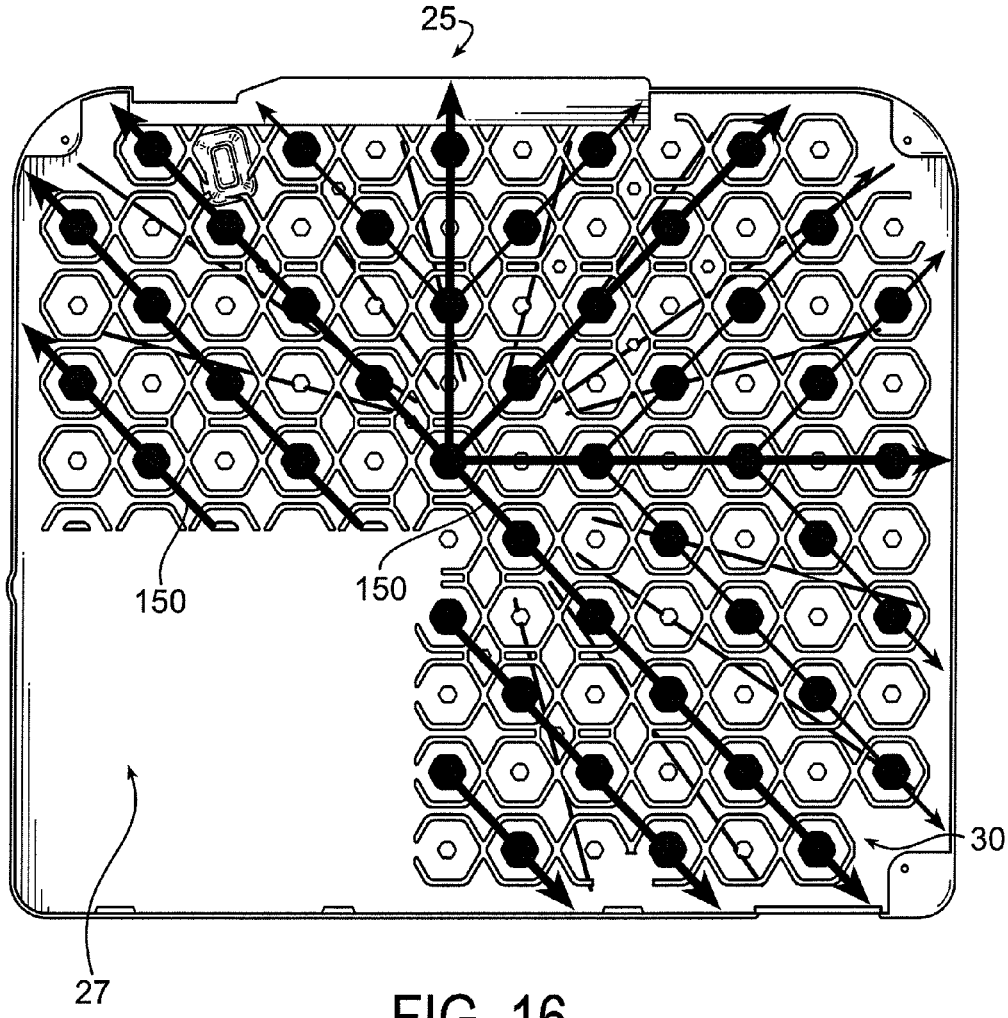

As shown in FIGS. 15 and 16, in one embodiment, the base tray 25 can comprise an array 30 configured to direct thermo-acoustic waves of low, mid, and high-frequencies in a particular direction along the base tray 25 to manage them. For example, the array 30 may be configured to direct mid-frequency thermo-acoustic waves along mid-frequency paths 160, shown as arrows in FIG. 15, based on the location and configuration of mid-frequency nodes 60 to encourage mid-frequency thermo-acoustic waves to travel along a desired path. In the depicted embodiment, the mid-frequency thermo-acoustic waves are encouraged to travel to a mid-frequency node 60 and then be dispersed toward another mid-frequency node 60 by interaction with the mid-frequency node member 64.

Similarly, the array 30 may be configured to direct low-frequency thermo-acoustic waves along low-frequency paths 150, shown as arrows in FIG. 16, based on the location and configuration of low-frequency nodes 50. The low-frequency thermo-acoustic waves are encouraged to travel to low-frequency nodes 50 and disperse through interaction with the low-frequency node member 54 toward another low-frequency node 50.

In this way, a range of thermo-acoustic waves can be encouraged to travel in either pre-determined channels 140, 170 or along pre-determined paths 150, 160 throughout the array 30 so the thermo-acoustic waves can be properly managed and controlled. As such, the array 30 can disperse the thermo-acoustic waves, thereby attenuating the sound being emitted by the dishwasher.

Dishwashers 10 with a base tray 25 comprising an array 30 of thermo-acoustic nodes 40, as shown in FIGS. 3-16, have shown a significant reduction in overall sound power levels created during operation in dishwashers. Experimental testing performed in three different types of dishwashers show overall sound power level reductions when comparing the overall sound levels with use of conventional stiff base trays to the overall sound levels with use of the base tray 25 including thermo-acoustic nodes, as described herein. For instance, Table 1 shown below illustrates the differences in overall sound power levels (unweighted and A-weighted). The testing was performed by measuring the sounds and vibrations during a normal wash cycle with and without a drying cycle.

TABLE 1

Experimental Overall Sound Power Levels

| Tray Type | Overall Sound Power Level (with dry), dB (A-weighted) | Overall Sound Power Level (without dry), dB (A-weighted) | Overall Sound Power Level (with dry), dB | Overall Sound Power Level (without dry), dB |
|---|---|---|---|---|
| Product 1 Base Tray | 45.2 | 46.0 | 58.5 | 59.2 |
| Product 1 Base Tray with Thermo-Acoustic Nodes | 44.4 | 44.4 | 56.8 | 56.8 |
| Product 2 Base Tray | 46.6 | 47.5 | 60.3 | 61.3 |
| Product 2 Base Tray with Thermo-Acoustic Nodes | 44.4 | 44.4 | 55.5 | 55.5 |
| Product 3 Base Tray | 44.8 | 45.6 | 56.5 | 57.4 |
| Product 3 Base Tray with Thermo-Acoustic Nodes | 43.9 | 43.9 | 56.4 | 56.3 |

Many modifications and other aspects of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A base tray operably engaged with a dishwashing appliance and configured to manage and control vibrations and/or sound waves in order to attenuate noise generated by the dishwashing appliance in an operational state, said base tray comprising:

a major surface; and an array of nodes disposed on the major surface and defined by a plurality of rows and a plurality of columns, at least two of the nodes configured to channel the vibrations and/or sound waves therebetween so as to control and manage the vibrations and/or sound waves, thereby attenuating the noise associated with the vibrations and/or sound waves, wherein each of the nodes comprises an outer wall member protruding outwardly from the major surface and a node member positioned within the outer wall member and protruding outwardly from the major surface, and wherein at least two of the nodes are interconnected by the outer wall members.

2. A base tray according to claim 1, wherein at least two of the nodes are interconnected between adjacent rows of the array.

3. A base tray according to claim 1, wherein at least two of the nodes are interconnected between adjacent columns of the array.

4. A base tray according to claim 1, further comprising distribution channels defined between the outer wall members of adjacent nodes.

5. A base tray according to claim 1, wherein a height of the outer wall member is greater than a height of the node member positioned therein.

6. A base tray according to claim 1, wherein the node member comprises a convex surface.

7. A base tray according to claim 1, wherein a plurality of the nodes comprise a hexagonal or a diamond shape.

8. A base tray according to claim 7, wherein adjacent nodes are interconnected by sharing a common side.

9. A base tray according to claim 7, wherein a plurality of the nodes comprise a hexagonal shape and a plurality of the nodes comprise a diamond shape.

10. A base tray according to claim 1, wherein a plurality of the nodes are different sizes than one another.

11. A base tray according to claim 1, wherein the base tray and each of the nodes are integrally formed from a single piece of material.

12. A base tray according to claim 1, wherein the array of nodes is configured to attenuate noise having a frequency of between about 50 Hz and about 10 kHz.

13. A base tray according to claim 12, wherein the array of nodes comprises a plurality of low-frequency nodes configured to attenuate noise having a frequency between about 50 Hz and about 300 Hz.

14. A base tray according to claim 13, wherein the array of nodes comprises a cluster of interconnected low-frequency nodes.

15. A base tray according to claim 12, wherein the array of nodes comprises a plurality of mid-frequency nodes configured to attenuate noise having a frequency between about 300 Hz and about 7 kHz.

16. A base tray according to claim 15, wherein the array of nodes comprises a cluster of interconnected mid-frequency nodes.

17. A base tray according to claim 12, wherein the array of nodes comprises a plurality of high-frequency nodes configured to attenuate noise having a frequency between about 7 kHz and about 10 kHz.

18. A base tray according to claim 17, wherein the array of nodes comprises a cluster of interconnected high-frequency nodes.

19. The base tray according to claim 1, wherein the outer wall members define a planar surface that interconnects a plurality of the nodes.

20. The base tray according to claim 1, wherein the node members are independent of and spaced from the outer wall members.

21. The base tray according to claim 1, wherein at least one of the outer wall members defines a shape that is the same as the shape of the one of the node members positioned therein.

22. A method for managing and controlling vibrations and/or sound waves in order to attenuate noise generated by a dishwashing appliance in an operational state, said method comprising:

providing a base tray comprising:

a major surface; and an array of nodes disposed on the major surface and defined by a plurality of rows and a plurality of columns, wherein each of the nodes comprises an outer wall member protruding outwardly from the major surface and a node member positioned within the outer wall member and protruding outwardly from the major surface, and wherein at least two of the nodes are interconnected by the outer wall member; and channeling the vibrations and/or sound waves between the nodes so as to control and manage the vibrations and/or sound waves and to thereby attenuate the noise associated with the vibrations and/or sound waves.

23. A method of manufacturing a base tray operably engaged with a dishwashing appliance and configured to manage and control vibrations and/or sound waves in order to attenuate noise generated by the dishwashing appliance in an operational state, the method comprising:

forming a base tray comprising a major surface and an array of nodes disposed on the major surface and defined by a plurality of rows and a plurality of columns, wherein each of the nodes comprises an outer wall member protruding outwardly from the major surface and a node member positioned within the outer wall member and protruding outwardly from the major surface, and wherein at least two of the nodes are interconnected by the outer wall member, at least two of the nodes configured to channel the vibrations and/or sound waves therebetween so as to control and manage the vibrations and/or sound waves, thereby attenuating the noise associated with the vibrations and/or sound waves.

* * * * *